US005601527A

United States Patent [19]

Selkowitz

[11] Patent Number: 5,601,527

[45] Date of Patent: Feb. 11, 1997

[54] SPINE SLING SUPPORT

[76] Inventor: David M. Selkowitz, 4920 Coronado Ave., Oakland, Calif. 94618

[21] Appl. No.: 485,627

[22] Filed: Jun. 7, 1995

[51] Int. Cl.[6] ..... A61H 1/00

[52] U.S. Cl. ..... 601/23; 602/36; 482/69; 254/413

[58] Field of Search ..... 482/43, 69, 23, 482/24; 602/32, 36; 606/241; 254/316, 335, 336, 413, 414, 415; 5/84.1, 88.1; 472/15; 182/3, 13, 231

[56] References Cited

U.S. PATENT DOCUMENTS

| | | | |
|---|---|---|---|
| 3,701,395 | 10/1972 | Theobald . | |
| 4,236,600 | 12/1980 | Wooten . | |
| 4,298,091 | 11/1981 | Anderson . | |
| 4,303,041 | 12/1981 | Thompson et al. . | |
| 4,410,175 | 10/1983 | Shamp | 482/69 |
| 4,440,261 | 4/1984 | Clark . | |
| 4,563,023 | 1/1986 | Clarkson | 182/3 |
| 4,567,963 | 2/1986 | Sugimoto . | |
| 4,645,034 | 2/1987 | Griffith . | |
| 4,671,384 | 6/1987 | Sing . | |
| 4,895,328 | 1/1990 | Ryan | 602/32 |
| 4,942,943 | 7/1990 | Flaherty . | |
| 4,997,064 | 3/1991 | Motte et al. | 182/231 |
| 5,080,191 | 1/1992 | Sanchez | 182/3 |
| 5,149,059 | 9/1992 | Monahan | 254/415 |
| 5,178,590 | 1/1993 | Stephens | 482/23 |
| 5,273,502 | 12/1993 | Kelsey et al. | 482/69 |

FOREIGN PATENT DOCUMENTS

| | | | |
|---|---|---|---|
| 2324322 | 4/1977 | France | 182/3 |
| 2611136 | 8/1988 | France | 602/36 |
| 1085605 | 4/1984 | U.S.S.R. | 482/69 |

*Primary Examiner*—Richard J. Apley
*Assistant Examiner*—Jeanne M. Clark

[57] ABSTRACT

A back and body support for maintaining a person in an antigravity position, primarily forward bending, with minimal muscle activity, force, and fatigue and, therefore, compressive loading on the spine. It also allows for changing position without such muscle activity or compressive loading, and without requiring the use of the hands, and without obstructing the performance of desired functions. It accomplishes this with a motor, spool, support line, pulleys, vest, belaying track, and remote control switch. The motor can produce rotation of the spool in either direction, and sufficient braking. The vest fastens at the front for easy and posturally sound donning and doffing. The spine sling support is particularly useful for people who must maintain forward-bent postures for prolonged periods, and especially for people with a history of back pain and dysfunction. It allows continued function with decreased pain.

10 Claims, 5 Drawing Sheets

SPINE SLING SUPPORT

BACKGROUND

1. Field of Invention

This invention relates to ergonomic and health-care devices used for back support.

2. Description of Prior Art

In response to the large incidence and prevalence of back injuries, inventors created different types of back braces to aid in the prevention of injuries, the decrease of pain, and the return to normal function or work duties. Some of these braces are made of soft flexible materials, and others are made of hard rigid materials. These braces are used primarily to provide tactile feedback so that wearers are aware of their backs and are more careful about how they move (e.g., soft braces), or are used after surgeries to prevent people from moving.

The soft braces, because they are flexible, only limit back movement to a small degree. Therefore, they allow people to get in positions which can result in injury or reinjury, including forward-bent positions, which increase the compressive forces on the spine. They also do not decrease the amount of muscle activity necessary for a person to perform a task, especially if that person is in a forward-bent position. Therefore, they do not decrease the compressive forces on the spine and do not prevent injury or reinjury, or decrease pain, caused by compressive loading of the spine or by contraction of the muscles.

The hard braces do limit the range of motion of the back to a large extent (although not fully) but, in doing so, they typically prevent people from performing their normal daily functions or work duties. In addition, they may allow motion at the hip, allowing people to be in a forward-bent position. This will increase the compressive loading on the spine, even more than if they were not wearing a brace due to the added weight of the brace. This will not result in a decrease in back muscle activity, and will probably increase the activity due to the added weight of the brace. This will result in further increased compressive loading and pain.

In summary, there are currently no back support devices that allow people with back pain and dysfunction, exacerbated by compressive forces acting on the spine, to perform functions with decreased back pain in positions that would tend to increase compressive forces on the spine (e.g., forward bending). There are currently no such devices that can counteract the forces that would increase compressive loading of the spine, and that can decrease the effort required by the back muscles to perform tasks while counteracting forces that would pull them forward. There are currently no devices that act to prevent injuries under the above conditions.

There exists prior art that discloses various harnesses and cabling systems for supporting a person in a harness. All of these are safety systems designed to prevent people from falling off a building or for lowering people from a building. None of these specifically addresses the problem of supporting a person in a standing forward-bent position for extended periods of time for the purpose of performing particular tasks. Also, none of these provide a means for the user to control the movement of the belaying or safety line, or for doing so while keeping the hands free.

OBJECTS AND ADVANTAGES

Therefore, several objects and advantages of my invention are:

1) decreasing the activity and force output of the back muscles that would be necessary to perform tasks in positions that would tend to bend people forward;
2) providing support to people in positions that would tend to bend them forward, thereby decreasing the back muscle activity and force necessary for this support;
3) decreasing compressive loading of the spine in the above positions;
4) decreasing or preventing back pain, discomfort, exertion, and fatigue in the above positions;
5) allowing people to perform tasks in the above positions while decreasing or preventing back pain, discomfort, exertion, and fatigue;
6) allowing people to perform tasks in front of them or to either side, in the above positions, without the invention getting in the way or otherwise restricting them (while still fulfilling objects 1 through 5);
7) allowing people full access to their particular workplace or area where they must perform their primary tasks, in the above positions, that they would otherwise be unable to perform due to back injury or the risk thereof (while still fulfilling objects 1 through 5);
8) allowing people to adjust their distance to and from the object (living or inanimate) with which they are working, while still fulfilling objects 1 through 5 (e.g., allowing the user to control the movement of the belaying line while keeping the user's hands free to perform the task; without requiring the muscles of the back or other regions to adjust the body's position).
9) allowing people to don and doff the vest component of the invention quickly and easily, and without twisting the spine.

Further objects and advantages of my invention will become apparent from a consideration of the drawings and ensuing description.

SUMMARY

My spine sling support invention is a back and body support for maintaining a person in an anti-gravity position, primarily forward bending, with minimal muscle activity, force, and fatigue and, therefore, compressive loading on the spine. It also allows for changing position without such muscle activity or compressive loading, and without requiring the use of the hands, and without obstructing the performance of desired functions. It accomplishes this with a motor, spool, support line, pulleys, vest, belaying track, and remote control switch. The motor can produce rotation of the spool in either direction, and sufficient braking. The vest fastens at the front for easy and posturally sound donning and doffing. The spine sling support is particularly useful for people who must maintain forward-bent postures for prolonged periods, and especially for people with a history of back pain and dysfunction. It allows continued function with decreased pain.

DESCRIPTION OF DRAWING FIGURES

FIG. 1 shows an aspect of the initial embodiment of my spine sling support device, and a user of said device, in a room with two of the walls evident (side wall holding motor 2, and adjacent wall).

FIG. 2*a* shows the front of Vest 10.

FIG. 2*b* shows the back of Vest 10.

DESCRIPTION OF INVENTION

Figure 1:
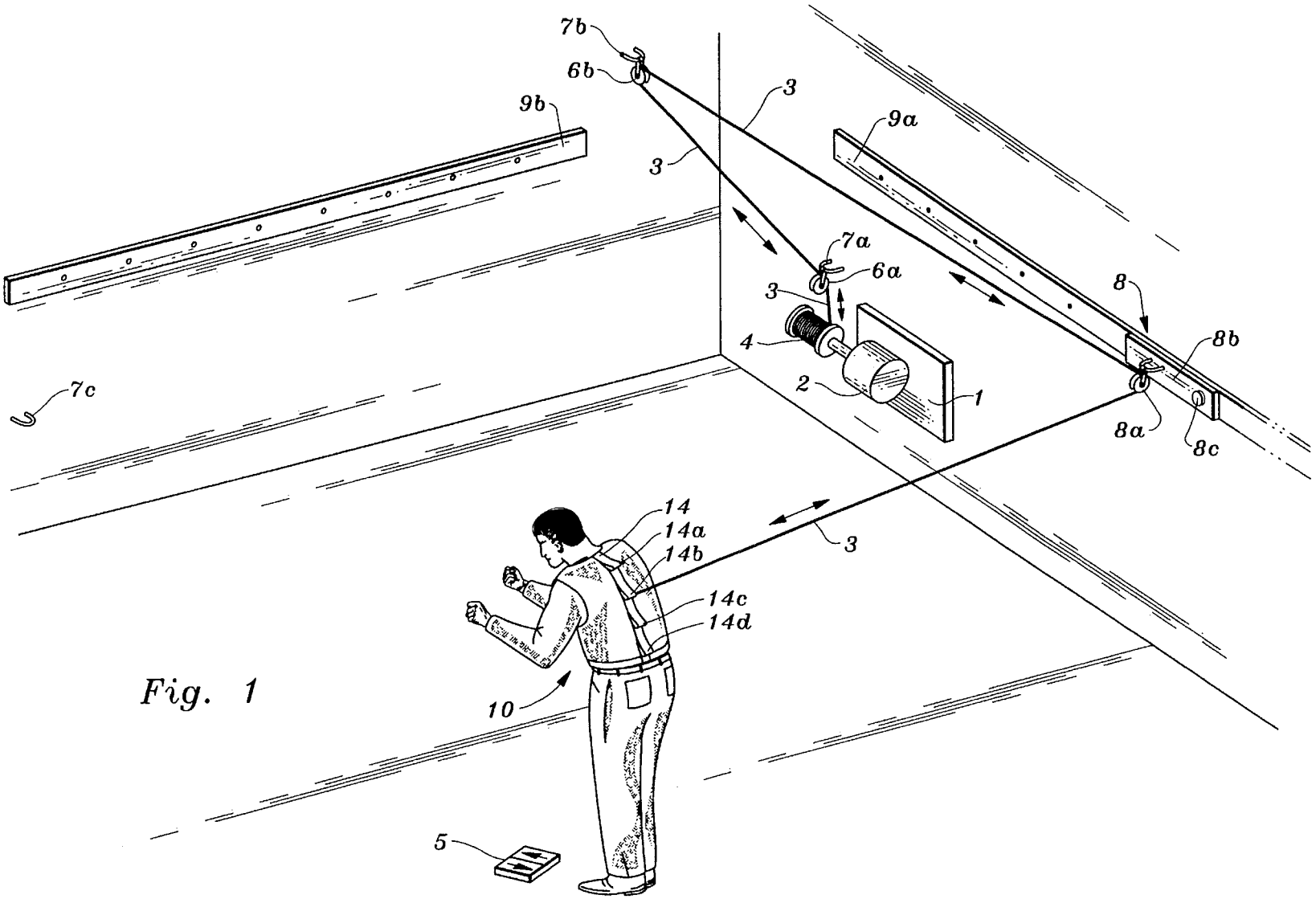

A typical embodiment of my spine sling support invention is illustrated in FIG. 1. The description will be for an area or workplace that comprises a room with at least three walls (two opposing side walls and one adjacent wall between them). A motor mount 1 is a rectangular metal plate approximately 25×30×1.25 cm., with brackets that act like a sleeve to hold a motor 2. Motor mount 1 is attached low onto one of the side walls of a room, near a corner where said side wall meets the adjacent wall. The long dimension of mount 1 is parallel to the floor, and the lower border is approximately 7.5 cm. up from the floor. Mount 1 is attached to the wall with approximately 6 mollys and screws. This location of mount 1 is chosen for its safety (i.e., low to the ground and out of the traffic pattern of the user) and economy of use of support line 3 (i.e., less is needed with a relatively central location near the head wall). Motor 2 in this embodiment is a Dayton permanent split-capacitor dual-rotation gear-motor with attached magnetic disc-braking mechanism, which is rated to resist torques of approximately 202 inch-pounds (a higher rated motor is used for a heavier user). Motor 2 is slid horizontally into the brackets of mount 1 which prevents it from slipping down; there is an added safeguard provided by slipping a nail through a hole in the upper bracket of mount 1 to block motor 2 from sliding in the mount. A spool 4 is connected to motor 2. Support line 3 is a nylon sailing line, approximately 1.6 cm. in diameter, that is anchored to spool 4. Line 3 is wound around (i.e., taken up) or unwound (i.e., let out) from spool 4 when motor 2 is engaged. The upper portion of motor 2 consists of a gear box. An electrical cord from the gear box is plugged into a wall socket. Rubber-encased thin copper wires from the gear box connect to a foot-box switch mechanism (or foot switch) 5. By stepping onto one side or the other of foot switch 5, motor 2 will turn spool 4 counter-clockwise or clockwise so that line 3 is either taken up or let out. Motor 2 will move line 3 at a rate of about five cm/sec, for as long as foot switch 5 remains depressed. This particular speed is both comfortable and efficient. When pressure is released from foot switch 5 by the user lifting the foot, motor 2 will not turn spool 4 and line 3 will not move.

Line 3, from its attachment to spool 4, passes vertically through a stationary swivel-pulley 6*a* which is attached, by means of its locking mechanism, to a hook 7*a* approximately three inches directly above spool 4. Hook 7*a* is anchored to the wall by approximately two screws. Pulley 6*a* enables line 3 to be taken up and let out from spool 4 in a uniform manner (with its vertical orientation) so line 3 does not miss a turn or slip off spool 4. Line 3 passes from pulley 6*a* through another stationary pulley 6*b* on the adjacent wall, approximately 7.5 cm. from the side wall (where motor 2 is mounted) and about as high as the user can reach overhead while flat-footed. Pulley 6*b* is attached to a hook 7*b* that is anchored to said adjacent wall by approximately two screws.

Line 3 passes from Pulley 6*b* to a sliding swivel-pulley 8. Pulley 8 comprises a swivel-pulley portion 8*a* that is attached to a thin rectangular metal mount portion 8*b* by means of a metal spring. Mount 8*b* is curved back on itself on the edges of its long sides, enabling it to be slipped onto any one of a plurality of aluminum sailing tracks 9*a*, 9*b*, and the like. Mount 8*b* of pulley 8 also contains a spring-loaded button portion 8*c* which, when pulled out, permits mount 8*b* to be slid along aluminum tracks 9*a*, 9*b*, and the like; button 8*c* will recoil when the pulling force is released. All of the previously discussed parts (i.e., numbers 1 through 9) comprise known prior art, and are commonly (except for numbers 1, 2, 4, and 5) used on sailboats.

Aluminum tracks 9*a*, 9*b*, and the like are each approximately one inch wide. Each track is attached to a different wall at approximately the user's shoulder height and parallel (lengthwise) to the floor. Each track is attached using screws, or screws through mollys, that are passed through screw holes located at approximately 10-cm. intervals along the length of each track. The use of all of these screw attachments to each wall further distributes the pulling force against line 3 and pulley 8, from the weight of the user, along the entire trackwall interface. Each track has button holes at approximately 3.3-cm. intervals along its length (between the screw holes) to receive the button of pulley 8. When the button of pulley 8 is released into a button hole of track 9*a*, *b*, or the like, pulley 8 becomes anchored to the track. This enables the user to work in a limited area by being belayed from the wall to which the particular track is attached.

Figure 2A:
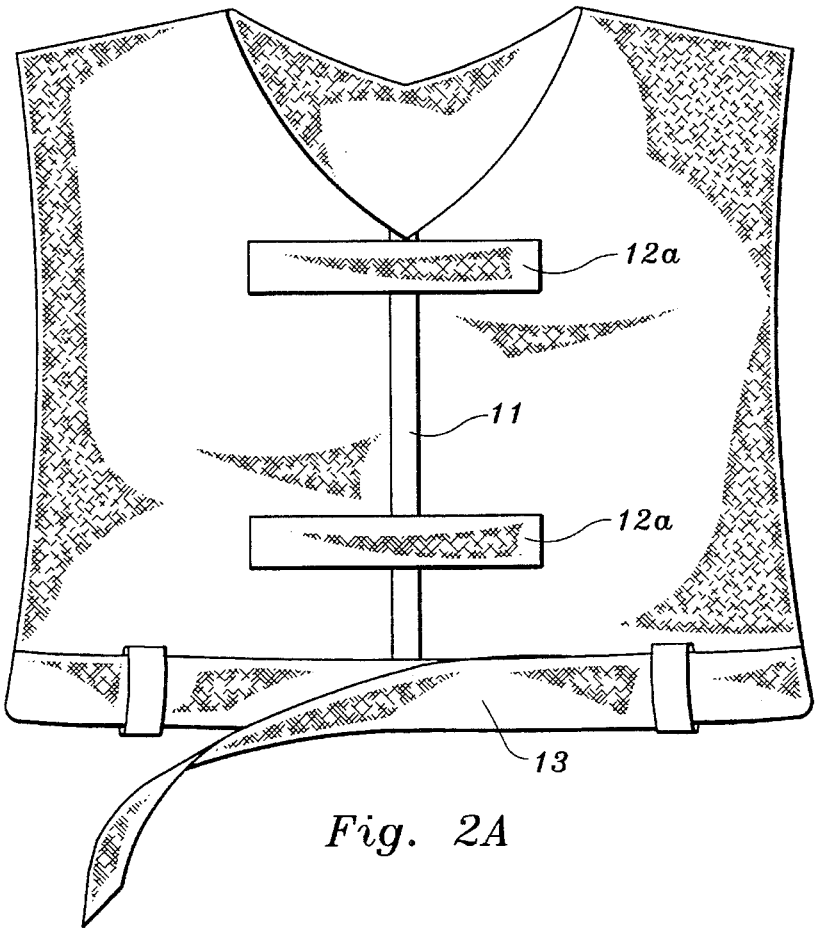
Figure 2B:
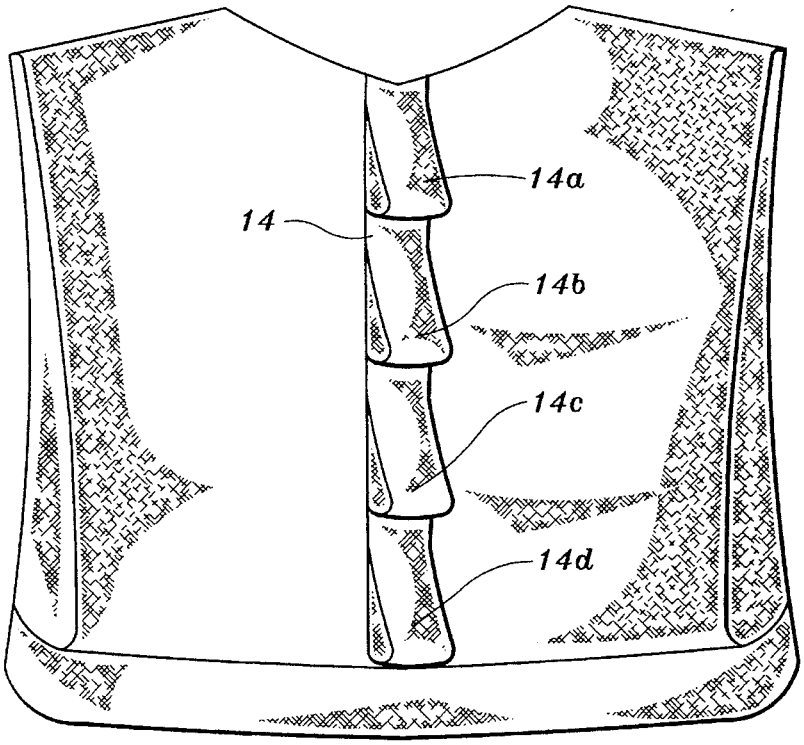

Line 3 passes from pulley 8 to a vest 10, which is worn by the operator around the upper trunk or thorax. Vest 10 in this embodiment is a sailing harness that has been custom-modified to fasten and unfasten at the front of the body; the front of Vest 10 is illustrated in FIG. 2*a*. The right and left sides of vest 10 fasten together in the front midline of the body by means of vertically-oriented Velcro-reinforced strips 11 along the entire length. There are two short horizontally-oriented Velcro-reinforced straps 12*a* and 12*b* that pass over midline Velco strips 11 to further connect the left side to the right side. There is a long horizontally-oriented Velcro-reinforced strap 13 at the lower border of vest 10 that also fastens the two sides of vest 10 together. The back of vest 10, illustrated in FIG. 2*b*, has been custom-modified with a thick nylon strip 14 sewn vertically from top to bottom along the midline, with four loops 14*a*, 14*b*, 14*c*, and 14*d* spaced approximately 2.5 cm. apart. Line 3 is tied to one of these loops; the choice of loop depends on user comfort with regard to the angle of pull of line 3 on the user's body from the wall. An additional embodiment of vest 10 is a modification by lining the front inner portion with a thin layer of orthoplast material custom-molded to the user's anterior thorax, and/or a thin innermost layer of closed-cell foam.

A hook 7*c* is anchored, using approximately two screws, to said adjacent wall approximately three inches from the second side wall (opposite the wall with motor 2), and at a height where the user can reach it by standing erect and flat-footed with the hands hanging down at the sides of the body. If the user wishes to work in an area requiring the user to be belayed from the second side wall, the user must unlock pulley 6*b* from hook 7*b* and attach and lock pulley 6*b* to hook 7*c*. This saves time that would otherwise be spent by letting up or taking out an excess length of line 3 when changing the belay point from one side wall to the other.

Figure 3:
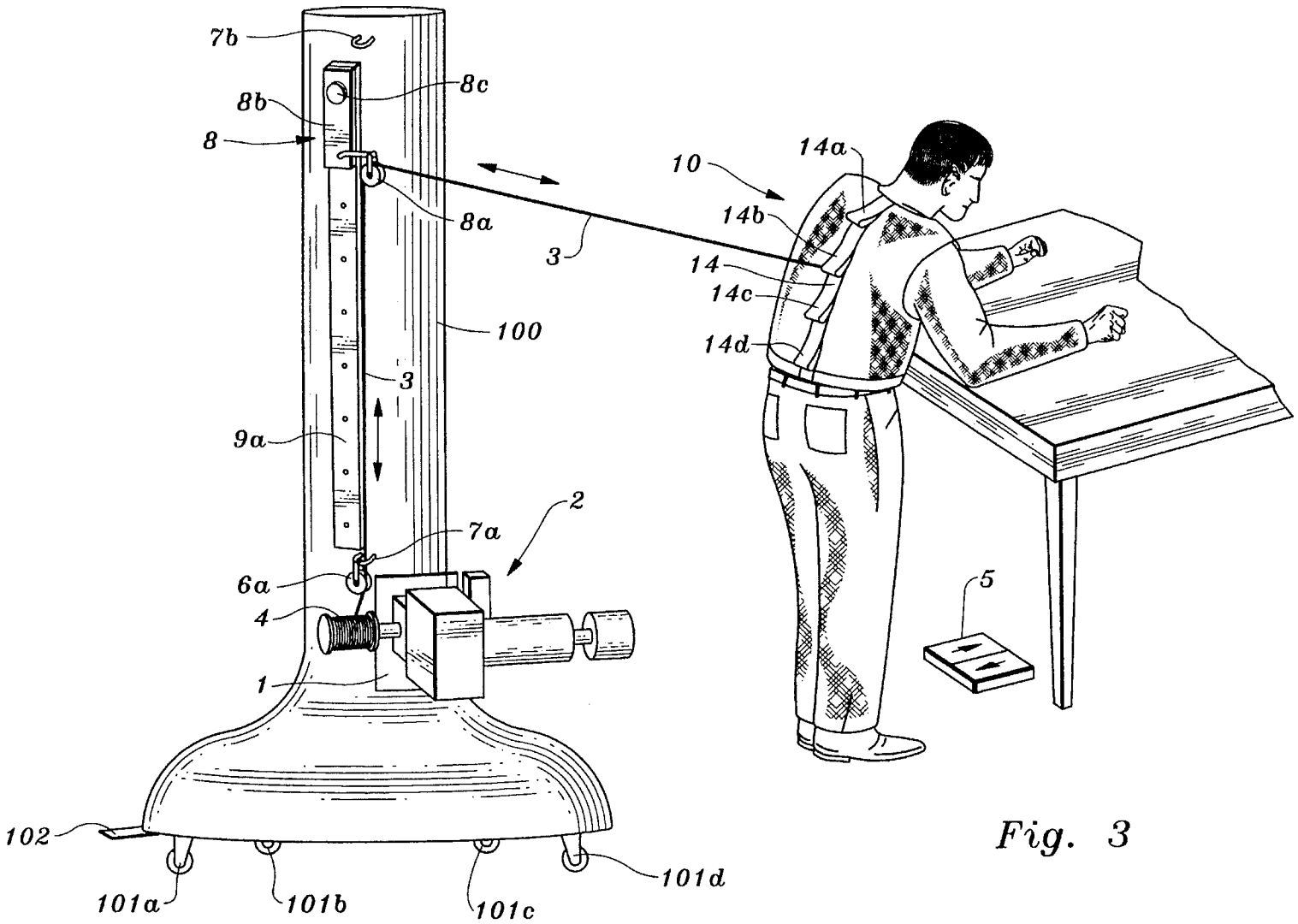
FIG. 3 shows a second embodiment of my spine sling support device comprising a heavy steel column with a wide base for belaying a user while said user works over a table.

An additional embodiment is shown in FIG. 3. This is portable. In this instance, motor mount 1 (and, therefore, motor 2) is anchored to a heavy metal column 100 with a wide base. Mount 1 is anchored to the bottom of the column before it widens at its base. Column 100 has approximately four wheels 101*a*, 101*b*, 101*c*, and 101*d* under its base to allow it to be rolled easily. A foot mechanism 102 allows the user to easily lower the base of column 100 to the floor to prevent it from rolling, and easily raise said base to allow wheels 101*a*, 101*b*, 101*c*, 101*d* to roll. One aluminum track is attached vertically to the column above spool 4, with line 3, pulley 8, vest 10, and foot switch 5 used as in the initial embodiment. A similar embodiment uses three hooks (e.g., 7*a*, 7*b*, and 7*c* from the initial embodiment) placed at different heights of column 100, with a pulley (e.g., 6*a*) that can be attached to any of the hooks; this is for users with different heights and/or different task requirements for the angle of forward-bending of the body; this serves the same function as the aluminum track with pulley 8.

Figure 4:
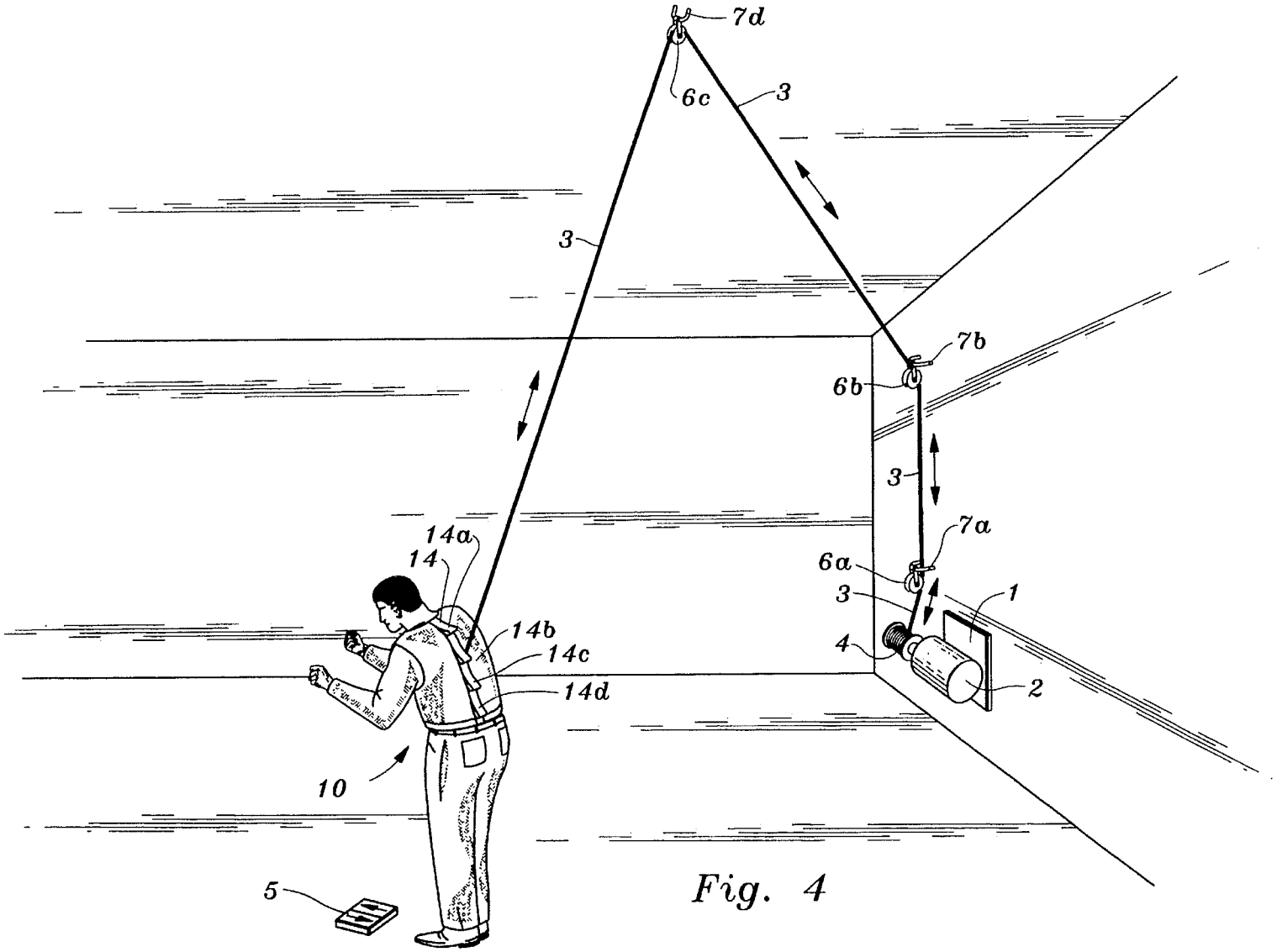
FIG. 4 shows a third embodiment of my spine sling support device comprising a hook-and-pulley belay point on the ceiling.
Figure 5:
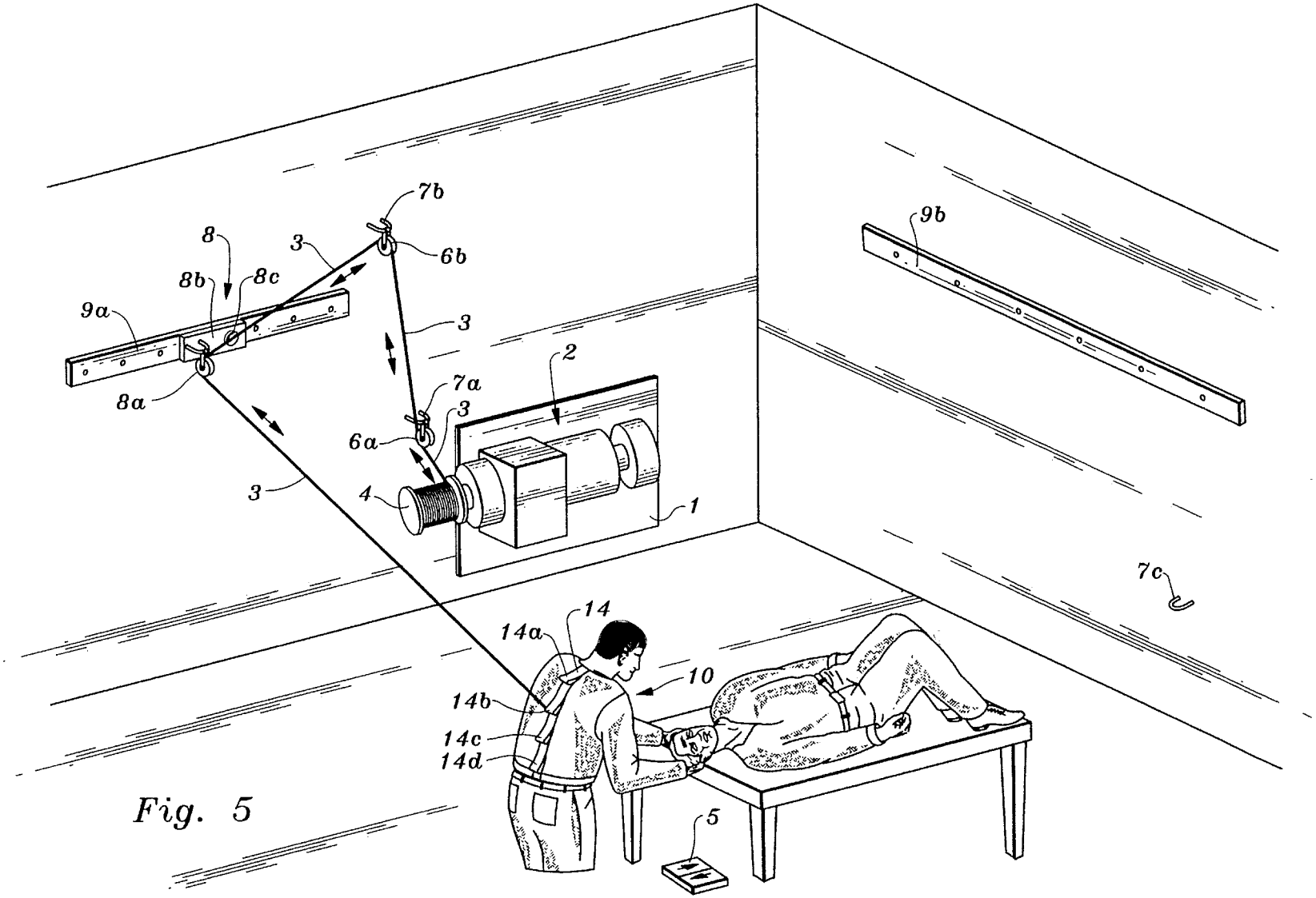
FIG. 5 shows the initial embodiment with a user/health care practitioner working over a person lying on a table.

A third embodiment is shown in FIG. 4. It modifies the initial embodiment by running line 3 vertically up the side wall that supports motor 2 to approximately ceiling height, using pulley 6*a* attached to hook 7*a* and pulley 6*b* attached to hook 7*b*. From pulley 6*b*, line 3 passes to pulley 6*a* attached to hook 7*d* attached to the ceiling at a point approximately over the workplace area. This embodiment is for tasks requiring excessive forward bending of the body and, therefore, a more acute belaying angle.

Operation of Invention

The manner of using the initial embodiment of the Spine Sling Support begins with the user donning vest 10, which already has line 3 tied to one of loops 14*a*, 14*b*, 14*c*, or 14*d*, in the midline of the back portion. The user fastens Velcro strips 11 and Velcro straps 12*a*, 12*b*, and 13 at the front portion of vest 10.

The user then steps or leans forward slightly to take up any slack in line 3. If the user wishes to work in an area requiring being belayed from the side wall on which motor 2 is mounted, then the user would attach pulley 6*b* to hook 7*b*. The user would then slide mount portion 8*b* of pulley 8 onto track 9*b*. The user would maintain a pulling pressure on button 8*c* of pulley 8 while sliding pulley 8 along track 9*b*, until reaching the part of track 9*b* from which the user wished to be belayed. Here, the user would release the pull on button 8*c* and allow button 8*c* to engage the corresponding button hole at this part of track 9*b*. If the user wished at some point to change the belay point along track 9*b*, the user would slide pulley 8 in the manner previously described. If the user wished to be further away from the belaying wall of track 9*b*, the user would depress the appropriate side of foot switch 5 (with either foot) which would cause motor 2 to rotate spool 4 and let out more of line 3. The user would step further away from the wall to prevent any slack in line 3. When the user was at the desired work area of the room the foot pressure on foot switch 5 would be released; the user would lean into, and assume and maintain the necessary forward-bent posture for the task at hand. The amount of forward bending (i.e., more or less) would be controlled by pressing the corresponding side of foot switch 5 until the desired posture was achieved; then the pressure of the foot on foot switch 5 is released. These alterations of position from the wall and inclination posture are thus achieved without use of the muscles and without use of the hands. Therefore, minimal body effort is required for assumption and maintenance of otherwise strenuous positions over long periods of time, and the hands remain free to continue with the task at hand. In addition, because pulley 8*a* swivels, there is a range of space (in a short arc of approximately 45 degrees) in which the user could work without needing to change locations along the same track.

The user can maintain a forward-bent or leaning position facing away from the belaying wall and be supported so as not to fall away from that wall. The user may perform any activities (otherwise within the user's capabilities) with at least one lower extremity supporting against the downward force of gravity. With no slack in line 3 and the user leaning into vest 10 (away from the belaying wall) for support, the compressive and tensile loads on the spine are minimized, as are the strains and force demands on the muscles. Therefore, prevention of injuries and protection from reinjury and exacerbation of existing problems, that may be affected by such loads and forces, are accomplished for the user.

The user could, according to the necessary task(s), change from being belayed from the side wall holding motor 2 to the adjacent wall. First, the user would depress foot switch 5 to engage motor 2 to take up line 3 onto spool 4, thereby moving the user into an upright posture. Then the user would apply and maintain a pulling pressure onto button 8*c* and slide pulley 8 off track 9*b*. The user would then slide pulley 8 onto track 9*a* which is attached to the adjacent wall; this would be accomplished in the same manner as previously described for sliding pulley 8 onto track 9*b* on the side wall holding motor 2. Operation from the adjacent wall would be the same as that described for the side wall holding motor 2.

Following the above described sequence, if the user then wished to change from being belayed from the adjacent wall to the side wall opposite the wall holding motor 2 (or, if the user wished to change from the side wall holding motor 2 to the opposite side wall), the following operation would be necessary. First, the user would return to the upright position in the manner previously described. Then, the user would slide pulley 8 off of track 9*a* on the adjacent wall (or, as the case might be, off of track 9*b* on the side wall holding motor 2). Then, the user would detach pulley 6*b* from hook 7*b*. The user would then attach pulley 6*b* to hook 7*c* and slide pulley 8 onto another track 9 (in the manner previously described for track 9*b*); this might entail letting out line 3 slightly further using foot switch 5 as previously described. The purpose of using hooks 7*b* and 7*c* alternatively for attachment of pulley 6*b* is to decrease the amount of line 3 that would be necessary to let out upon changing work areas from one side of a room to the opposite side; this would also necessarily save time. After changing the belaying walls thusly, use from this opposite side wall would be the same as described previously for the side wall holding motor 2.

If the user had started out from the opposite side wall instead of the wall holding motor 2, the above sequence would simply be the converse. Also, if the user would not require changing work areas in the room, there would be no need to change the wall from which the user is belayed; pulley 8 would remain on the appropriate track 9*a*, b, or c; if this were, the typical situation for the type of work or workplace, there would be no need to include more than one wall or track for belaying a user, and there would be no need for a hook 7*c*. Hook 7*b* and pulley 6*b* would still be preferred to decrease the amount of line 3 to be let out or taken up (and, therefore, the time necessary) when changing position along one track.

The second embodiment described in the "Description of Invention" section would be appropriate for any situation that would apply to the initial embodiment, except that it is more mobile. The second embodiment would be especially appropriate for situations where the workplace consisted of a huge room or area where there were either no walls, the walls were far from where the particular tasks needed to be performed, or the walls were inaccessible.

The third embodiment described in the "Description of Invention" section would be appropriate in situations where a side wall or adjacent wall were inaccessible to a track, and the user could remain in one area without needing to change substantially (e.g., not more than the arc of swivel pulley 8 would allow) to perform the desired task.

Operation for both the second and third embodiments are the same as that described for the initial embodiment with the following minor exceptions. The second embodiment would involve changing the height of pulley 8 along a vertically-oriented track, appropriate to the user's height and the task at hand (or selecting a hook *7a*, *7b*, or *7c* at the appropriate height for attachment of a pulley *6a*). Neither the second nor the third embodiment would require the part of the operation described for the initial embodiment which involved changing the belaying walls or tracks. In the second embodiment, the user could change work area by rolling the heavy metal base. In the third embodiment, the user would not substantially change the work area.

Summary/Conclusion, Ramifications, and Scope of Invention

From both the "Description of Invention" and "Operation of Invention" sections, the following advantages of my spine sling support become evident:

—it provides support to the body and spine while in positions that would otherwise result in the user falling forward or to the side;

—it enables a user to change said user's position or location in an area (e.g., of a room) according to where a task needs to be performed;

—it enables said user to change posture with respect to the amount of forward bending, either moving more forward or backward (e.g., erect) according to the demands of a task, at a comfortable and efficient speed;

—it enables this change in posture, without obstructing or otherwise restricting the user from the task, via a motor and a remote control switch that allows the user to maintain the hands free;

—it provides such support and allows for such changes in posture without requiring the back muscles to perform these functions, decreasing the amount of activity and force output necessary by the muscles and, therefore, the compressive load on the spine;

—it allows easy and posturally sound donning and doffing of the vest component via front fasteners.

—it allows users, including those with back pain and dysfunction, to continue to safely perform, with decreased fatigue and pain, tasks that would otherwise put them at risk for (further) back injury.

The preferred embodiment and the additional embodiments demonstrate the use of a dynamic, safe, and efficient mechanism for allowing people, especially those with histories of back injuries, to continue to work in positions that would be otherwise unsafe for the back. It is relatively easy to use and can be tailored to suit the particular demands of the tasks and the workplace, including portability. It is especially useful for people who must work in a forward-bent posture for an extended period of time (e.g., physical therapists, physicians and surgeons, dentists, assembly-line workers, and many others; also, anyone with decreased trunk control such as people with paraplegia).

Additional Ramifications and Embodiments of Invention

Although the description above contains several specificities, these should not be construed as limiting the scope of the invention, but merely as providing illustrations of some of the presently preferred embodiments of this invention. For example, this includes but is not limited to differences in dimensions of portions of the apparatus of the invention; e.g., size of motor mount 1, heights of parts from the floor, distances between screw holes and button holes on tracks *9a*, *9b*, and the like, number of loops on the back of vest 10, etc.

It will be apparent to those skilled in the art that various substitutions or modifications may be made without departing from the spirit of this invention or the scope of the appended claims. Therefore, the scope of the invention should be determined by the appended claims and their legal equivalents, rather than by the examples given.

I claim:

1. A spine sling support device for upper body support against gravity, while allowing performance of a function and access to a desired area for performance of said function, said device comprising:

body support means releasably secured to an upper thorax portion of a user to support the upper thorax of the user against gravity in a variable forward inclined posture and to minimize compression and tension applied to the spinal column of the user;

a support line connected to said body support means;

a motor mounted on a substantially rigid and stable surface, and a spool secured to the output shaft of said motor;

said support line wound about said spool and adapted to be let out and taken up;

remote control means operated by the user to rotate said motor and spool and selectively take up or let out said line and control tension on said line; and, means for engaging a portion of said line extending between said spool and said body support means and belaying the user, said means for engaging defining a selectively variable angular relationship between said portion of said line and said body support means at any location within the desired area.

2. The spine sling support device of claim 1, wherein said motor comprises:

means for rotation of said spool at a constant speed in either direction to let out or take up said support line.

3. The spine sling support device of claim 2, wherein said motor comprises:

braking means for stabilizing said support line, said body support means, and the user while the user wears said body support means.

4. The spine sling support device of claim 1, wherein said body support means includes a vest having front fastening means, and further including means for connecting said support line to a rear portion of said vest.

5. The spine sling support device of claim 4, wherein said means for connecting includes a plurality of connectors secured to said rear portion of said vest and spaced along a longitudinal midline of said rear portion of said vest, whereby the rear support point of said vest may be selected by securing said support line to a selected one of said plurality of connectors.

6. The spine sling support device of claim 1, wherein said remote control means includes foot switch means adapted for engagement by the user at any location within the desired area.

7. The spine sling support device of claim 6, wherein said remote control means comprises:

adjacent areas which, when one or the other is depressed, engages said motor to rotate said spool in either direction to either take up or let out line, depending on which said adjacent area is depressed.

8. The spine sling support device of claim 1, wherein said means for engaging includes a plurality of belay points on at least one fixed structure adjacent to the desired area, pulley means for engaging said portion of said line, and means for removably securing said pulley means to any of said belay points.

9. The spine sling support device of claim 8, further including at least one track secured to said at least one fixed structure, said plurality of belay points spaced apart along said track.

10. The spine sling support device of claim 9, further including a plurality of said tracks.

* * * * *